United States Patent [19]

Scremin

[11] Patent Number: 4,971,224

[45] Date of Patent: Nov. 20, 1990

[54] VALVE AND CONTAINER WITH A VALVE

[75] Inventor: Gérard Scremin, Pinel, France

[73] Assignee: Application Des Gaz, Paris, France

[21] Appl. No.: 216,207

[22] Filed: Jul. 7, 1988

[30] Foreign Application Priority Data

Jul. 7, 1987 [FR] France ..... 87 09988

[51] Int. Cl.[5] ..... B67D 5/00

[52] U.S. Cl. ..... 222/3; 222/325; 222/402.1; 222/402.14; 222/402.25; 137/322; 220/3; 126/52; 251/333; 251/339; 431/142; 431/344

[58] Field of Search ..... 222/402.1, 402.14, 402.25, 222/394, 3, 325, 395, 402.11, 402.12, 402.13, 501; 251/339, 333, 321, 330, 337; 141/346, 348, 349, 353, 366, 21, 19; 137/320, 322; 220/3; 431/142, 143, 344; 126/38, 52, 46, 42, 44

[56] References Cited

U.S. PATENT DOCUMENTS

| | | | |
|---|---|---|---|
| 2,890,815 | 6/1959 | Corlet | 431/142 X |
| 3,127,072 | 3/1964 | Webster | 222/3 |
| 3,393,843 | 7/1968 | Webster | 222/3 X |
| 3,613,960 | 10/1971 | Beard | 222/402.1 X |
| 3,785,335 | 1/1974 | Wagner | 222/402.1 X |
| 4,082,993 | 4/1978 | Oakes | 222/3 X |

FOREIGN PATENT DOCUMENTS

| | | | |
|---|---|---|---|
| 1170436 | 3/1964 | Fed. Rep. of Germany | 222/402.1 |
| 2556164 | 6/1977 | Fed. Rep. of Germany . | |
| 2272581 | 12/1975 | France . | |
| 2398962 | 7/1977 | France . | |
| 2407423 | 10/1977 | France . | |
| 2112122 | 7/1983 | United Kingdom . | |

*Primary Examiner*—H. Grant Skaggs
*Assistant Examiner*—David H. Bollinger
*Attorney, Agent, or Firm*—Oliff & Berridge

[57] ABSTRACT

The present invention relates to a valve and container provided with such a valve, which can be used with portable apparatus using fuel gas, normally operating with piercable cartridges. The valve according to the invention is characterized by the presence of a concave surface on the top of the axial boss of the cup. The corresponding transverse seal assumes the same concave shape as the top of the boss.

12 Claims, 2 Drawing Sheets

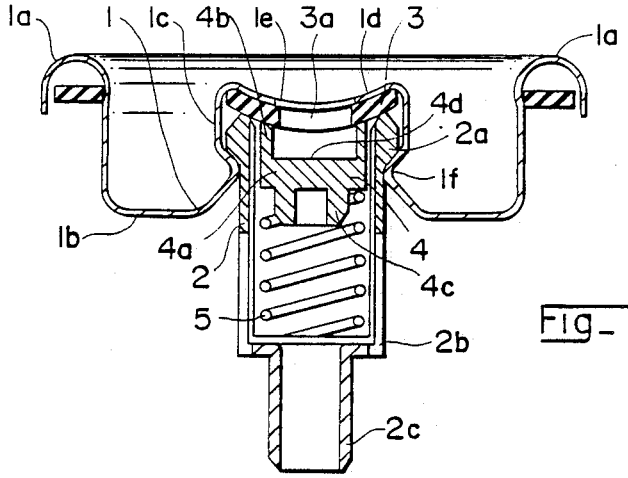
Fig- 1
Fig- 2
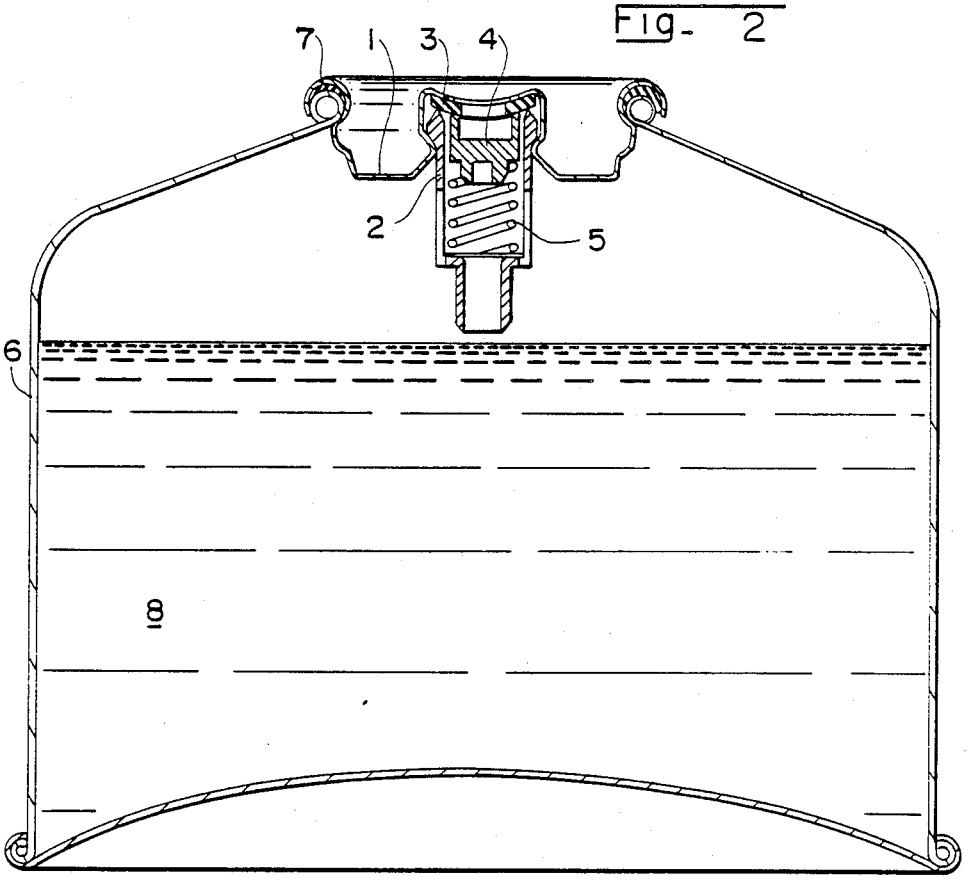

VALVE AND CONTAINER WITH A VALVE

FIELD OF THE INVENTION

The present invention relates to a new valve, and also to a container, in particular of the type which can be thrown away after use, fitted with such a valve.

The invention will be defined and described with reference to apparatus with a gas burner, of portable type, having different functions such as cooking and lighting, operating by means of a throw-away container containing a fuel gas, for example butane in liquefied condition and under pressure. But it should be understood that the claims of the present patent and the scope of the invention should not be limited to this technical area.

In general, the apparatus mentioned above have:

(a) a main body, generally of metal, having a passage for flow of fuel gas under pressure to the burner;

(b) a means for control of the rate of flow of gas to the burner, consisting of a simple valve, for example a needle valve, for apparatus known as "direct pressure", or of an adjustable pressure-reducing valve for apparatus known as "indirect pressure" or reduced pressure.

(c) a means of securing the throw-away container to the main body, on the one hand enabling rigid location of the said container relative to the said body, and on the other hand ensuring a gastight connection between the interior of the container, once the latter has been opened, and the passage for flow of fuel gas; all of this in a reversible manner so that one can replace an empty used container by a new full one.

PRIOR ART

Among the apparatus thus defined in general terms one should distinguish two particular categories of apparatus.

The first, known as "for pierceable cartridges" uses containers of the type which can be pierced, generally constituted like a can for food by a cylindrical body closed at one end by a convex wall, filled with liquefied butane, and then closed at the other end by a concave base crimped onto the body.

Apparatus of this first category differ from the general definition above by the fact that the means of securing the pierceable cartridge comprise:

(1) a gas inlet head, forming part of the main body, having: firstly, a tubular push rod movable axially by sliding in a gastight manner (for example by means of a toroidal seal) relative to the said body and urged downwards by resilient means, for example a spring; secondly an annular seal carried by the free end of the push rod, intended to be engaged sealingly against the central part of the convex wall of the cartridge; thirdly a piercing needle, arranged within the tubular push rod and mounted on the body of the gas inlet head, for example having an extension opposite from the free end of the needle, gripped between the body of the gas inlet head and one end of the spring.

(2) a support intended to cover the convex wall of the cartridge, open downwards for this purpose, on which is permanently fixed the main body with the gas inlet head, or on which the same body is fixed in a removable manner, for example by screwing; means complementary to the support, for example a screw-up case or folding arms, enabling the pierceable cartridge to be fixed to the body once the latter is in position on the support.

Such an apparatus is described for example by patent FR-C-2,398,962.

The second type, known as "for valved cartridges", uses containers of the type of those used as aerosol generators. These cartridges comprise in general a can constituted by a cylindrical body with a concave base crimped on, possibly a dome mounted on the body, and a valve crimped in a gastight manner on the can, for example after filling. This valve is of the "female" type, that is it does not have any means enabling the user to open it directly, such as a rod standing out from the valve.

The valve in question, made for many years and in millions, has in general the shape of a solid of revolution about an axis, and comprises:

(1) a metal cup, for example having an overall diameter of 2.5 cm, forming, in succession from the outside towards its center, an annular rim, a bottom situated in a lower transverse plane (perpendicular to the axis of the valve) situated below the annular rim, an axial boss having for example an external diameter of 9.5 mm, standing out from the transverse bottom, the top of which has a central opening for example having a diameter of 3 to 3.25 mm; the central opening of the boss is generally surrounded by an external annular rim, having in axial section the shape of a hook.

(2) a valve body of plastic material, of cylindrical shape, fixed to the interior of the axial boss, for example by inward shrinking, in a gastight manner, due to a flat resilient seal gripped between the wall of the body and the top of the boss; this seal has a central hole having for example a diameter of 2.5 to 3.8 mm.

(3) a valve member of plastic material, movable in the interior the body, urged resiliently towards the top of the boss by a spring, having a central part and a peripheral lip, having for example an internal diameter of 3.1 to 4 mm, engaging against the transverse seal in the closed position of the valve member; the travel of the valve member between the closed position and the position with the spring totally compressed is for example 2.5 mm, while its thickness is for example 2 mm.

The dimensions given above by way of example correspond for example to a valve known as "one inch", of "female" type.

The apparatus for valved cartridges differ from the general definition above by the fact that the means for securing the cartridge comprises:

(1) a gas inlet head, forming part of the main body, having a tubular push rod intended to pass through the central opening of the axial boss of the cup and make sealing contact with the transverse seal, and possibly a sealing means externally with the axial boss.

(2) means for rigid securing of the body and its gas inlet head on at least one of the following elements of the cup, namely on the interior and underneath the annular rim, on the exterior and underneath the rim of the can onto which is crimped the annular rim of the valve, and below the shrunk part of the axial boss.

Such apparatus are for example described by French patent FR-C-2,407,423.

It will be apparent from the description above that the apparatus for pierceable cartridges are distinct as regards use from apparatus for valved cartridges, and that in particular a pierceable cartridge, without a valve, cannot be used on an apparatus for valved cartridges.

Nevertheless, a manufacturer has already proposed valved cartridges which can be used with an apparatus for pierceable cartridges. Here one is concerned with cartridges fitted with conventional aerosol valves, of the "female" type as described above.

Used with an apparatus designed for pierceable cartridges, such cartridges are not free from risks, in particular in relation to the sealing needed between the valve and the body of the apparatus.

This sealing presumes a coaxial abutment of the annular seal of the tubular push rod against the central boss of the cup of the valve. In this connection, this boss does not allow one to compensate for any variation in coaxiality, due to tolerances of manufacture of the cup and/or of the gas inlet head of the apparatus.

This sealing also presumes maintenance of the valve in operational condition, in its closed position, because the user is in the habit of removing the cartridge from his apparatus, not necessarily empty, after using the latter. Now, using an apparatus for pierceable cartridges with a valved cartridge amounts to using the piercing needle as a push rod. Since this needle is relatively free with respect to the axis of the valve and of the apparatus, and since the apparatus is in general fixed to the cartridge by screwing, the needle then behaves like a machining tool, and can permanently damage the axial boss and/or the valve member, and hence the gastightness of the latter, especially as a consequence of departures from concentricity.

In consequence, for all these reasons, it is the opinion of the applicant that using cartridges with conventional valves with apparatus for pierceable cartridges can cause danger to the user, since any escape of fuel gas from the cartridge (valved) on its own, or from the assembly of cartridge and apparatus (at the connection between the axial boss and the gas inlet head) must be prevented.

SUMMARY OF THE INVENTION

The present invention relates to a new valve permitting a cartridge fitted with such a valve to be used without danger with an apparatus for pierceable cartridges.

A valve according to the present invention differs from a conventional aerosol valve by a particular shape of the axial boss of the cup, suited to a particular dimensioning of the central opening of the said boss and of other functional elements of the valve associated with that opening.

According to the invention, first of all the central opening of the axial boss of the valve is relatively wide, as compared with that of conventional aerosol valves, and is equal to at least 4 mm in diameter. Correspondingly, on the one hand the diameter of the central hole of the transverse seal, and on the other hand the internal diameter of the peripheral lip of the valve member, are beyond those found in a conventional aerosol valve; and the same is true of the overall diameter of the axial boss.

Furthermore, according to the invention, and cooperating with the choice of dimensions above, on the one hand the top of the axial boss has externally a concave surface, extending radially from the central opening, and on the other hand the transverse seal assumes the concave shape of the top as mentioned above.

The larger diameter of the central opening and of the functional elements of the valve associated with associated with it permits the piercing needle to enter, without doing damage, within the limits of departures of the needle from coaxiality.

Since the axial boss has a greater diameter than that of aerosol valves, the gastightness between the lip of the valve member and the transverse seal would normally be impaired, because it would occur on the flat, along an annular zone of greater diameter. Owing to the concave shape according to the invention, both of the top of the axial boss and of the transverse seal, the same gastightness is produced along a circle corresponding to the line of contact between the edge of the lip of the valve member and the transverse seal; thus one obtains a good specific sealing, compensating for the increase in diameter, yet with a comparable bearing force from the spring.

It should be added that this concave shape of the axial boss enables self-centering of the tubular push rod for sealing, which is particularly favorable to the overall gastightness of the connection between cartridge and apparatus.

BRIEF DESCRIPTION OF THE DRAWINGS

The present invention will now be described with reference to the accompanying drawings, in which:

FIG. 1 shows a view in axial section of a valve according to the present invention, before being crimped onto the body of a can of aerosol type;

FIG. 2 shows a view in axial section of a container according to the present invention, in the filled condition, in particular a valved cartridge containing butane;

DESCRIPTION OF THE PREFERRED EMBODIMENTS

Figure 3:
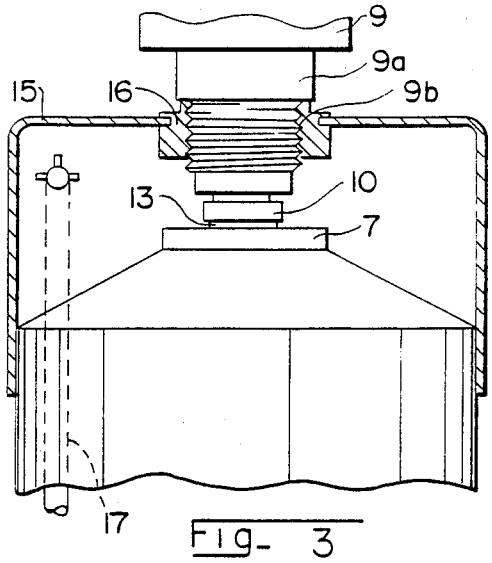
FIG. 3 shows a view, partly cut away, of a cartridge according to the invention mounted on a traditional apparatus for pierceable cartridges.

As shown in FIG. 1, a valve according to the invention has the shape of a solid of revolution about an axis, and comprises:

(1) a metal cup (1) forming, in succession from the outside towards its center, an annular rim (1*a*), a bottom (1*b*) situated in a lower transverse plane (perpendicular to the axis of the valve), below the annular rim (1*a*), an axial boss (1*c*) standing out from the transverse plane (1*b*), the top (1*d*) of which has a central opening (1*e*); this top (1*d*) has externally a concave shape, more particularly spherical, extending radially starting from the central opening (1*e*); the plane in which the edge of the concave face (1*d*) lies is situated below the plane in which the annular rim (1*a*) lies.

(2) a valve body (2), fixed by inward shrinking of the boss (1*c*) against the shoulder (2*a*) of the said body; this body is mounted in a gastight manner to the interior of the boss (1*c*), by means of a resilient transverse seal (3), assuming the concave shape of the top (1*d*) of the boss, gripped between the wall of the body (2) and the top (1*c*) of the said boss; this seal (3) likewise has a central hole (3*a*), lying within the opening (1*e*) of the boss (1*d*); the wall of the body (2) has openings (2*b*) towards the exterior, and also a tube (2*c*) directed downwards, forming a retaining shoulder for a spring (5) which will be considered later.

(3) a valve member (4) which is movable in translation in the interior of the body (2), urged resiliently by the spring (5) towards the top (1*d*) of the boss (1*c*), having a central part (4*a*) and a peripheral lip (4*b*), the latter bearing on the transverse seal (3), in the closed position of the valve member shown in FIG. 1; the central part (4*a*) is extended downwards by a spigot (4*c*) serving for retention and guidance of the spring (5).

As indicated in the introduction of the present description, the valve described above has dimensional and functional characteristics which distinguish it from the conventional valves for aerosol containers.

The diameter of the circle inscribed within the central opening (1*e*) is equal to at least 4 mm, and is for example of the order of 5.2 mm.

Correspondingly, the peripheral lip (4*b*) of the valve member (4) has an internal diameter equal to at least 4.5 mm and is for example of the order of 5.2 to 5.7 mm. Also correspondingly, the external overall diameter of the boss (1*c*) is equal to at least 10 mm and is for example equal to 11.5 mm.

As shown in FIG. 1, the central hole (3*a*) of the transverse seal (3) has a diameter (that of the inscribed circle) less than that of the central opening (1*e*), so that its edge stands out from that of the said opening (1*e*); this diameter is for example of the order of 4.4 mm. Hence, the seal (3) can act as a guide for the piercing needle of an apparatus for valved cartridges, when the latter enters into the central opening (1*e*).

As is also shown in FIG. 1, the concave surface (1*d*) of the boss (1*c*), in the shape of a dish, is perfectly uniform and smooth, from the flat edge of the central opening (1*e*) to the peripheral rim of the same boss (1*c*), rounded towards the bottom of the cup; this being different from conventional valves, the central opening of which has an edge turned back upwards, having a hook shape in axial section. This characteristic enables one to avoid any alteration or deterioration of the annular seal of an apparatus for pierceable cartridges, when the latter comes into contact with the top (1*d*) of the boss (1*c*) as described below.

In the closed position of the valve member shown in FIG. 1, the external face (4*d*) of the central part (4*a*) is located at a distance equal to at most 3 mm from the center of the central opening (1*e*). Despite the small distance of penetration of the piercing needle of an apparatus for pierceable cartridges into the valve shown in FIG. 1, this feature enables one to depress the valve member (4) sufficiently to provide a sufficient flow of emerging gas, even if the piercing needle penetrates by screwing for a slight distance into the central part (4*a*) of the valve member.

The thickness of the central part (4*a*) of the valve member (4) is equal to at least 2 mm, which allows the latter to withstand suffer any "machining" caused by the linear and rotational movement of the piercing needle of an apparatus for pierceable cartridges.

Between its totally compressed condition, against the shoulder (2*c*) of the valve body (2), and its expanded condition shown in FIG. 1, corresponding to the closed condition of the valve, the spring (5) determines a travel of the valve member equal to at least 3 mm. This travel enables one to accommodate the movement of the valve member (4) in the least favorable case corresponding to a maximum penetration of the piercing needle into the opening (1*e*), under the effect of cumulation of dimensional variations along the axis of the valve.

The manufacture and assembly of the valve described above are carried out in a conventional manner. However, the shaping of the top (1*d*) and the punching of the opening (1*e*) are performed with particular care, so as not to produce any visible edge or burr capable of cutting, that might damage the annular seal of an apparatus for pierceable cartridges.

FIG. 2 shows a container of the throw-away cartridge type with a valve, comprising a body (6) or can in the opening of which is fixed, by crimping, in a gastight manner owing to the seal (7), a valve according to the present invention and described above with reference to FIG. 1. This container holds a charge of liquefied butane (8).

Figure 4:
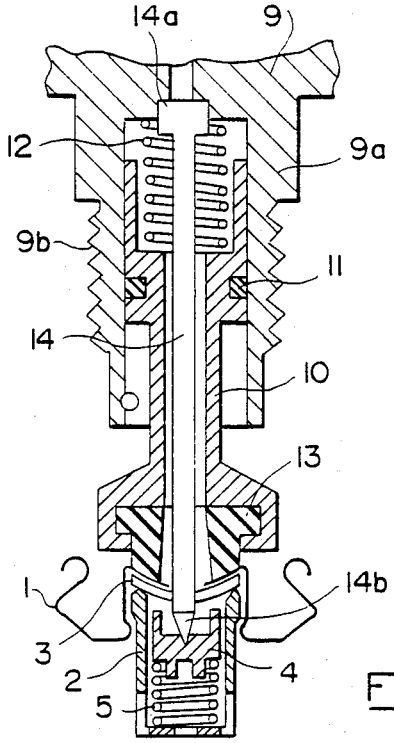
FIG. 4 shows in axial section, on a larger scale, the connection between, on the one hand the head of the apparatus for pierceable cartridges as shown in FIG. 3, and on the other hand the valve according to the invention, in the open condition, corresponding to the operating position shown in FIG. 3.

With reference to FIGS. 3 and 4, without there being the need to enter into details, a conventional apparatus for pierceable cartridges comprises:

(1) a gas inlet head (9*a*), being part of the main body (9) of the apparatus, comprising firstly a tubular push rod (10) slidably movable axially in a gastight manner (for example by means of a toroidal seal (11)) relative to the body (9), and urged downwards by a spring (12); secondly an annular seal (13) carried by the free end of the push rod (10), which is intended normally to be applied in a gastight manner against the central hollow portion of the convex wall of a pierceable cartridge; thirdly a piercing needle (14), pointed at its free end, arranged in the interior of the tubular push rod (10), and mounted in a rotationally fixed manner on the body (9) of the gas inlet head by means of an extension (14*a*) (opposite to the free end (14*b*)) held between the body (9) of the gas inlet head and the end of the spring (12) opposite to the one abutting against the push rod (10).

(2) a support (15), for example in the form of a bell, intended to cover the convex part of the pierceable cartridge, open downwards for this purpose, on which the body (9) is fixed by screwing, thus being removable, this body having a thread (9*b*) cooperating with a threaded sleeve (16) fixed on the support (15); supplementary means (17), for example folding arms, enabling one to secure the pierceable cartridge to the body (9) once the latter has been fully screwed up into position on the support (15).

As regards pierceable cartridges, the method of use of an apparatus such as has been described above is the following:

one has in the interior of the support (15) a cartridge which is full and has not been pierced, and one folds the arms (17) into a vertical position around the cartridge (as shown in FIG. 3);

then one screws the body (9) onto the support (15) by means of the threaded sleeve (16); in this way the tubular push rod (10), provided with its seal (13), comes into sealing engagement against the central part of the convex dome of the cartridge, then the piercing needle (14) breaks through the wall of the cartridge within the annular seal (13); and conversely when dismantling the apparatus, for removing a cartridge which is pierced and empty.

With a cartridge according to the present invention, the method of use is absolutely identical to that described above, with the difference that a valved cartridge according to the invention can be removed at will from an apparatus, without there being the need to consider whether the cartridge is empty or not.

As shown in FIG. 4, when one uses a cartridge according to the invention, and following the method of use described above, firstly the annular seal (13) makes a sealing engagement against the concave wall (1*d*) of the central boss (1*c*) of the valve, and then the piercing needle (14) enters into the opening (1*e*), while being guided by the central hole (3*a*) in the seal (3) so as to engage the central part (4*a*) of the valve member (4).

From this moment, the latter is then displaced by the needle (14*b*), which causes opening of the valve, with previous complete gastightness between the apparatus and the cartridge. As shown in FIG. 4, the piercing needle (14*b*) can machine the central part (4*a*) of the valve member during its rotating descent, without any possibility of this leading to damage to the valve.

I claim:

1. A valve of the female aerosol type, intended to be compatible with apparatus for use with piercable cartridges having an annular seal and a piercing needle arranged within said annular seal, said valve having the shape of a solid of revolution and comprising:

a metal cup forming, in succession from the outside towards it center, an annular rim, a bottom situated in a lower transverse plane below the annular rim, an axial boss standing out from the transverse plane, the top of which has a central opening, said top having a concave surface extending radially from the central opening to the peripheral rim of the boss, and the opening having a diameter to accommodate concentricity variations of the piercing needles of the appliances;

a valve body fixed in a gas-tight manner to the interior of the boss a valve member movable in the interior of the valve body, urged resiliently towards the top of the boss, having a central part for receiving the tip of a piercing needle and a peripheral lip a resilient transverse seal enclosed in said boss, having a concave shape, in correspondence to the concave surface of the top of the boss, said seal being engaged by the peripheral lip of the valve member in the closed position of the latter.

2. A valve as claimed in claim 1, wherein the concave surface of the top of the axial boss has a spherical shape.

3. A valve as claimed in claim 1, wherein the concave surface of the top of the boss is uniform from the edge of the central opening to the peripheral rim of the said boss, and wherein the peripheral rim is rounded.

4. A valve as claimed in claim 1, wherein the peripheral lip of the valve member has an internal diameter equal to or greater than the diameter of the central opening in the boss.

5. A valve as in claim 4, wherein the peripheral lip of the valve member is upstanding toward the top of the axial boss.

6. A valve as in claim 1, wherein the peripheral lip of the valve member is upstanding toward the top of the axial boss.

7. A container for fluid under pressure comprising:

a body for containing the fluid under pressure; and a valve of the female aerosol type, intended to be compatible with apparatus for use with piercable cartridges having an annular seal and a piercing needle arranged within said annular seal, said valve having the shape of a solid of revolution and comprising:

a metal cup forming, an succession from the outside towards its center, an annular rim, a bottom situated in a lower transverse plane below the annular rim, an axial boss standing out from the transverse plane, the top of which has a central opening, said top having concave surface extending radially from the central opening to the peripheral rim of the boss, and the opening having a diameter to accommodate concentricity variations of the piercing needles of the appliances a valve body fixed in a gas-tight manner to the interior of the boss a valve member movable in the interior of the valve body, urged resiliently towards the top of the boss, having a central part for receiving the tip of a piercing needle and a peripheral lip a resilient transverse seal enclosed in said boss, having a concave shape, in correspondence to the concave surface of the top of the boss, said seal being engaged by the peripheral lip of the valve member in the closed position of the latter.

8. A container as in claim 7, wherein the concave surface of the top of the axial boss has a spherical shape.

9. A container as claim 8 and further comprising a quantity of liquified gas in the container.

10. The container as in claim 9 wherein liquified gas is butane.

11. A container as in claim 7, wherein the concave surface of the top of the boss is uniform from the edge of the central opening to the peripheral rim of the said boss, and wherein the peripheral rim is rounded.

12. A container as in claim 7, wherein the peripheral lip of the valve member has an internal diameter equal to or greater than the diameter of the central opening in the boss.

* * * * *